US009193930B2

(12) United States Patent
Corradi et al.

(10) Patent No.: US 9,193,930 B2
(45) Date of Patent: Nov. 24, 2015

(54) LUBRICATING OIL COMPOSITION

(71) Applicant: Infineum International Limited, Abingdon (GB)

(72) Inventors: Marco Corradi, Oxford (GB); Roberta Bomparola, Oxford (GB)

(73) Assignee: INFINEUM INTERNATIONAL LIMITED (GB)

( * ) Notice: Subject to any disclaimer, the term of this patent is extended or adjusted under 35 U.S.C. 154(b) by 120 days.

(21) Appl. No.: 13/953,784

(22) Filed: Jul. 30, 2013

(65) Prior Publication Data

US 2014/0034003 A1 Feb. 6, 2014

(30) Foreign Application Priority Data

Jul. 31, 2012 (EP) ..... 12005576

(51) Int. Cl.

| | |
|---|---|
| ***C10L 10/08*** | (2006.01) |
| ***C10M 133/02*** | (2006.01) |
| ***C10M 133/16*** | (2006.01) |

(52) U.S. Cl.

CPC ..... *C10L 10/08* (2013.01); *C10M 133/02* (2013.01); *C10M 133/16* (2013.01); *C10M 2207/021* (2013.01); *C10M 2207/028* (2013.01); *C10M 2207/122* (2013.01); *C10M 2207/144* (2013.01); *C10M 2207/262* (2013.01); *C10M 2207/281* (2013.01); *C10M 2215/08* (2013.01); *C10M 2215/221* (2013.01); *C10M 2215/224* (2013.01); *C10M 2219/046* (2013.01); *C10M 2223/045* (2013.01); *C10M 2227/066* (2013.01); *C10N 2230/12* (2013.01); *C10N 2240/101* (2013.01); *C10N 2240/103* (2013.01); *C10N 2240/104* (2013.01)

(58) Field of Classification Search

CPC ..... C10M 133/02; C10M 133/16; C10M 2207/021; C10M 2207/028; C10M 2207/122; C10M 2207/144; C10M 2207/262; C10M 2207/281; C10M 2215/08; C10M 2215/221; C10M 2215/224; C10M 2219/046; C10M 2223/045; C10M 2227/066; C10L 10/08; C10N 2230/12

See application file for complete search history.

(56) References Cited

U.S. PATENT DOCUMENTS

| | | | | |
|---|---|---|---|---|
| 2,466,517 A | | 4/1949 | Blair et al. | |
| 2,598,213 A | | 5/1952 | Blair | |
| 2,956,020 A | | 10/1960 | Suprin et al. | |
| 3,167,554 A | | 1/1965 | Ernst | |
| 5,190,680 A | * | 3/1993 | Bullen et al. | 508/287 |
| 5,395,539 A | * | 3/1995 | Chandler et al. | 508/260 |

FOREIGN PATENT DOCUMENTS

| | | |
|---|---|---|
| EP | 2169037 A1 | 3/2010 |
| EP | 2290041 A2 | 3/2011 |

* cited by examiner

*Primary Examiner* — Cephia D Toomer

(57) ABSTRACT

The use, in the lubrication of a spark-ignited or compression-ignited internal combustion engine which is fuelled with a biofuel, of a minor amount of an oil-soluble or oil-dispersible additive component (B), as defined herein, in combination with a minor amount of an oil-soluble or oil-dispersible additive component (C), as defined herein, in a lubricating oil composition, to reduce and/or inhibit the corrosion of the metallic engine components, wherein the lubricating oil composition becomes contaminated with the biofuel during operation of the engine.

15 Claims, No Drawings

LUBRICATING OIL COMPOSITION

FIELD OF THE INVENTION

The present invention relates to automotive lubricating oil compositions, more especially to automotive lubricating oil compositions for use in gasoline (spark-ignited) and diesel (compression-ignited) internal combustion engines fuelled with a biofuel, especially compression-ignited internal combustion engines fuelled with a biodiesel fuel and spark-ignited internal combustion engines fuelled with an alcohol based fuel (e.g. bioethanol), crankcase lubrication, such compositions being referred to as crankcase lubricants.

In particular, although not exclusively, the present invention relates to automotive lubricating oil compositions, preferably having low levels of phosphorus and also low levels of sulfur and/or sulfated ash, which exhibit an improved inhibition of corrosion of the metallic engine parts during operation of the engine which is fuelled with a biofuel; and to the use of additives in such compositions for improving the anti-corrosion properties of the lubricating oil composition.

BACKGROUND OF THE INVENTION

A crankcase lubricant is an oil used for general lubrication in an internal combustion engine where an oil sump is situated generally below the crankshaft of the engine and to which circulated oil returns. The contamination or dilution of the crankcase lubricant in internal combustion engines, especially engines fuelled with a biofuel, is a concern.

Biodiesel fuels include components of low volatility which are slow to vaporize after injection of the fuel into the engine. Typically, an unburnt portion of the biodiesel and some of the resulting partially combusted decomposition products become mixed with the lubricant on the cylinder wall and are washed down into the oil sump, thereby contaminating the crankcase lubricant. The biodiesel fuel in the contaminated lubricant may form further decompositions products, due to the extreme conditions during lubrication of the engine. It has been found that the presence of biodiesel fuel and the decomposition products thereof in the crankcase lubricant promotes the corrosion of the metallic engine parts. Moreover, it has been found that this problem is significantly worse in diesel engines which employ a late post-injection of fuel into the cylinder (e.g. light duty, medium duty and passenger car diesel engines) to regenerate an exhaust gas after-treatment device.

Exhaust gas after-treatment devices, such as a diesel particulate filter (DPF), require periodical regeneration to remove the build-up of soot and to prevent them from having a detrimental effect on engine performance. One way to create conditions for initiating and sustaining regeneration of a DPF involves elevating the temperature of the exhaust gases entering the DPF to burn the soot. As a diesel engine runs relatively cool and lean, this may be achieved by adding fuel into the exhaust gases optionally in combination with the use of an oxidation catalyst located upstream of the DPF. Heavy duty diesel (HDD) engines, such as those in trucks, typically employ a late post-injection of fuel directly into the exhaust system outside of the cylinder, whilst light duty and medium duty diesel engines typically employ a late post-injection of fuel directly into the cylinder during an expansion stroke. It has been found that the corrosion of the metallic, in particular the ferrous containing, engine components increases significantly in a diesel engine fuelled with biodiesel when the engine employs a late post-injection of fuel directly into the cylinder. Although only theory, it is believed this increased engine corrosion is due to more biodiesel being absorbed by the lubricant on the more exposed cylinder wall, thereby increasing contamination of the lubricant in the sump.

A similar increase in the corrosion of the metallic engine parts, particularly the ferrous containing engine components, has also been found to occur in spark-ignited internal combustion engines fuelled with an alcohol based fuel (e.g. bioethanol) due to the presence of the alcohol based fuel and the decomposition products thereof mixing with and contaminating the crankcase lubricant.

Accordingly, lubricating oil compositions with improved anti-corrosion properties in respect of the metallic engine components, particularly the ferrous containing metallic engine components (e.g. crankshaft components), during operation of the engine with a biofuel must be identified.

SUMMARY OF THE INVENTION

The present invention is based on the discovery that a lubricating oil can be formulated which exhibits significantly improved anti-corrosion properties, particularly in respect of the metallic engine components, especially those containing iron or an alloy thereof (e.g. steel), during operation of the engine which is fuelled and operated with a biofuel, especially during operation of a spark-ignited internal combustion engine which is fuelled and operated with an alcohol based fuel, such as an ethanol based fuel, especially a bioalcohol based fuel such as bioethanol fuel.

In accordance with a first aspect, the present invention provides a lubricating oil composition comprising:

(A) an oil of lubricating viscosity in a major amount;

(B) an oil-soluble or oil-dispersible additive component in a minor amount, obtainable by reacting:

(b1) an aliphatic polyamine having at least two carbon atoms and at least two nitrogen atoms with at least one of the nitrogen atoms present in the form of a primary amine group and at least one of the remaining nitrogen atoms present in the form of a primary or secondary amine group, and (b2) an aliphatic hydrocarbyl mono acid or derivative thereof of formula I

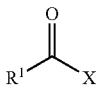

(I)

wherein $R^1$ represents a $C_9$ to $C_{29}$ aliphatic hydrocarbyl group and X represents —OH or a suitable leaving group in a compound of formula I, said reaction being conducted in a manner and under conditions sufficient to react at least one amine group of the aliphatic polyamine (b1) with the aliphatic hydrocarbyl mono acid or derivative thereof (b2) of formula I to form at least one amide and/or imidazoline group; and, (C) an oil-soluble or oil dispersible additive component in a minor amount of a primary amide of formula $R^6C(O)NH_2$ wherein $R^6$ represents a $C_9$ to $C_{29}$ aliphatic hydrocarbyl group.

Preferably, additive component (B) is substantially free of imidazoline containing groups. By substantially free of imidazoline containing groups is meant less than 5, preferably less than 1, and most preferably less than 0.5 mole % of compounds with imidazoline ring structures.

Preferably, the lubricating oil composition according to the present invention is a crankcase lubricant.

Preferably, the oil of lubricating viscosity comprises a Group III basestock.

It has unexpectedly been found that the combination of the oil-soluble or oil-dispersible additive component (B) and oil-soluble or oil-dispersible additive component (C) in a lubricating oil composition, particularly a lubricating oil composition including a Group III base stock, may provide a lubricant that exhibits an improved inhibition and/or a reduction in the corrosion of the metallic engine components, particularly the metallic engine components containing iron and/or an alloy thereof (e.g. steel components), in use, in the lubrication of a spark-ignited or compression-ignited internal combustion engine which is fuelled with a biofuel, especially during operation of a spark-ignited internal combustion engine which is fuelled and operated with an alcohol based fuel, such as an ethanol based fuel, especially a bioalcohol based fuel such as bioethanol fuel. In particular, the combination of the additive component (B) and additive component (C) in a lubricant, in use, may provide a positive credit in terms of reduced corrosion of the metallic engine components, particularly the ferrous containing metallic engine components, in the lubrication of a spark-ignited or compression-ignited internal combustion engine which is fuelled with a biofuel.

More specifically, it has unexpectedly been found that the combination of the oil-soluble or oil-dispersible additive component (B) and oil-soluble or oil-dispersible additive component (C) in a lubricating oil composition typically enables the lubricating oil composition to pass the stringent Volkswagen Corrosion Bench Test (VCBT) in accordance with PV 1492 (Issue 2012-11) which simulates the corrosion of iron and alloys thereof, such as steel found in the metal crankshaft, in an environment when the lubricating oil composition is contaminated with an alcohol based fuel, e.g. ethanol, water and acetic acid.

According to a second aspect, the present invention provides a method of lubricating a spark-ignited or compression-ignited internal combustion engine which is fuelled with a biofuel, comprising operating the engine with a lubricating oil composition, comprising: (A) an oil of lubricating viscosity in a major amount; an oil-soluble or oil-dispersible additive component (B), in a minor amount, as defined in accordance with the first aspect of the invention; and, an oil-soluble or oil-dispersible additive component (C), in a minor amount, as defined in accordance with the first aspect of the invention.

Suitably, the method of the second aspect reduces and/or inhibits the corrosion of the metallic, especially the ferrous containing, engine components. Preferably, the metallic engine components comprise of iron or an alloy thereof, such as steel.

According to a third aspect, the present invention provides a method of reducing and/or inhibiting the corrosion of the metallic engine components, especially the metallic engine components comprising of iron or an alloy thereof (e.g. steel), of a spark-ignited or compression-ignited internal combustion engine which is fuelled with a biofuel, the method comprising lubricating, preferably operating, the engine with a lubricating oil composition, particularly a crankcase lubricating oil composition, comprising (A) an oil of lubricating viscosity in a major amount; an oil-soluble or oil-dispersible additive component (B), in a minor amount, as defined in accordance with the first aspect of the invention; and, an oil-soluble or oil-dispersible additive component (C), in a minor amount, as defined in accordance with the first aspect of the invention.

According to a fourth aspect, the present invention provides the use, in the lubrication of a spark-ignited or compression-ignited internal combustion engine which is fuelled with a biofuel, of an oil-soluble or oil-dispersible additive component (B), in a minor amount, as defined in accordance with the first aspect of the invention, in combination with an oil-soluble or oil-dispersible additive component (C), in a minor amount, as defined in accordance with the first aspect of the invention, in a lubricating oil composition, to reduce and/or inhibit the corrosion of the metallic engine components, especially the metallic engine components comprising of iron or an alloy thereof (e.g. steel), wherein the lubricating oil composition becomes contaminated with the biofuel during operation of the engine.

According to a fifth aspect, the present invention provides a spark-ignited or compression-ignited internal combustion engine comprising a crankcase containing a lubricating oil composition as defined in accordance with the first aspect of the invention, wherein the engine is fuelled with a biofuel. Preferably, the engine is operating with a fuel comprising a biofuel and the engine is being lubricated with the lubricating oil composition.

Preferably, the lubricating oil composition according to the first aspect of the present invention and the lubricating oil compositions as defined in the second to fifth aspects of the invention are each independently contaminated with at least 0.3 mass %, based on the total mass of the lubricating oil composition, of a biofuel or a decomposition product thereof and mixtures thereof. Preferably, the biofuel is an alcohol based fuel, such as an ethanol based fuel, especially a bioalcohol based fuel such as bioethanol.

Preferably, the metallic engine components of the third and fourth aspects of the invention comprise components which include iron and iron alloys (e.g. steel), such as crankcase components.

Preferably, the engine of the second to fifth aspects of the present invention comprises a spark-ignited internal combustion engine. Suitably, the preferred spark-ignited internal combustion engine of the second to fifth aspects of the present invention is fuelled and operated with an alcohol based fuel, such as ethanol, preferably a bioalcohol based fuel, such as bioethanol.

It will be appreciated that when the engine of the second to fifth aspects of the invention comprises a compression-ignited internal combustion engine then the engine is fuelled and operated with a biodiesel fuel.

Preferably, the lubricating oil composition of the first aspect of the invention and as defined in the second to fifth aspects of the invention includes a dihydrocarbyl dithiophosphate metal salt anti-wear agent, such as ZDDP, as defined hereinafter.

Suitably, the lubricating oil composition of the first aspect of the invention and as defined in the second to fifth aspects of the invention includes a friction modifier, other than additive components (B) and (C), in particular an ashless friction modifier or an organo-molybdenum friction modifier as defined hereinafter. Unexpectedly, it has been found that the presence of such a friction modifier may further enhance the anti-corrosion properties of the lubricating oil composition. Preferred ashless friction modifiers include glyceryl monoesters of higher fatty acids e.g. glyceryl monooleate. Preferably, the ashless friction modifier, when present, is present in an amount of 0.1 to 5.0, more preferably 0.1 to 1.5, most preferably 0.2 to 1.0 mass % based on the total mass of the lubricating oil composition. Preferred organo-molybdenum friction modifiers include molybdenum dithiocarbamates and tri-nuclear molybdenum compounds as defined herein. Preferably, the organo-molybdenum friction modifier, when present, is present in an amount of 0.01 to 2, more preferably 0.05 to 0.5 mass %, based on the total mass of the lubricating oil composition.

Suitably, the lubricating oil composition may include one or more co-additives in a minor amount, other than additive components (B) and (C), selected from ashless dispersants, metal detergents, corrosion inhibitors, antioxidants, pour point depressants, antiwear agents, friction modifiers, demulsifiers, antifoam agents and viscosity modifiers.

Preferably, the oil-soluble or oil-dispersible additive component (B) in combination with the oil-soluble or oil-dispersible additive component (C) forms part of an additive package which also includes a diluent, preferably a base stock, and one or more co-additives in a minor amount, other than additive components (B) and (C), selected from ashless dispersants, metal detergents, corrosion inhibitors, antioxidants, antiwear agents, friction modifiers, demulsifiers and antifoam agents; the additive package being added to the oil of lubricating viscosity.

In this specification, the following words and expressions, if and when used, have the meanings ascribed below:

"active ingredients" or "(a.i.)" refers to additive material that is not diluent or solvent;

"alcohol based fuel" refers to a fuel including an alcohol, irrespective of the source of the alcohol, such as methanol, ethanol, propanol and butanol, especially ethanol. The term "alcohol based fuel" embraces pure alcohol based fuel (i.e. pure ethanol) and also alcohol based fuel blends comprising, for example, a mixture of an alcohol and petroleum gasoline;

"ethanol based fuel" refers to a fuel including ethanol and is otherwise defined in the same way as "alcohol based fuel";

"biofuel" refers to a biodiesel fuel, a bioalcohol fuel and an alcohol based fuel as defined herein (i.e. a fuel that does not consist of solely petroleum gasoline or petroleum diesel fuel). Preferably, the biofuel comprises biodiesel fuel, bioalcohol fuel and ethanol fuel as defined herein. More preferably, the term "biofuel" means a fuel derived at least in part from a renewable biological resource e.g. biodiesel fuel or bioalchohol fuel. Even more preferably the biofuel comprises biodiesel or bioethanol as defined herein, especially bioethanol fuel;

"biodiesel fuel" refers to a fuel derived at least in part from a renewable biological resource (e.g. derivable from a natural oil/fat, such as vegetable oils or animal fats) comprising at least one alkyl ester, typically a monoalkyl ester, of a long chain fatty acid. The term "biodiesel fuel" embraces pure biodiesel fuel (i.e. B100 as defined by ASTM D6751-08 (USA) and EN 14214 (Europe)) and also biodiesel fuel blends comprising a mixture of biodiesel fuel and another fuel, such as petroleum diesel fuel;

"bioalcohol fuel" refers to a fuel including an alcohol derived from a renewable biological resource (e.g. fermented sugar) and is otherwise defined in the same way as "alcohol based fuel";

"bioethanol fuel" refers to a fuel including ethanol derived from a renewable biological resource and is otherwise defined in the same way as "ethanol based fuel". The term "bioethanol fuel" embraces pure bioethanol fuel (i.e. pure bioethanol E100) and also bioethanol fuel blends comprising, for example, a mixture of bioethanol and petroleum gasoline;

"petroleum gasoline" refers to a gasoline fuel produced from petroleum;

"petroleum diesel fuel" refers to a diesel fuel produced from petroleum;

"bioethanol" refers to ethanol derived from a renewable biological resource;

"comprising" or any cognate word specifies the presence of stated features, steps, or integers or components, but does not preclude the presence or addition of one or more other features, steps, integers, components or groups thereof. The expressions "consists of or" consists essentially of or cognates may be embraced within "comprises" or cognates, wherein "consists essentially of" permits inclusion of substances not materially affecting the characteristics of the composition to which it applies;

"hydrocarbyl" means a chemical group (i.e. substituent) of a compound that contains hydrogen and carbon atoms and that is bonded to the remainder of the compound directly via a carbon atom. The group may contain, when permitted, one or more atoms other than carbon and hydrogen provided they do not affect the essentially hydrocarbyl nature of the group. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group);
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

Preferably, the term "hydrocarbyl" means a chemical group (i.e. substituent) of a compound that contains only hydrogen and carbon atoms and that is bonded to the remainder of the compound directly via a carbon atom.

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"major amount" means in excess of 50 mass % of a composition;

"minor amount" means less than 50 mass % of a composition, expressed in respect of the stated additive and in respect of the total mass of all the additives present in the composition, reckoned as active ingredient of the additive or additives;

"ppm" means parts per million by mass, based on the total mass of the lubricating oil composition;

corrosion control, particularly the corrosion of iron and alloys of iron (e.g. steel), is measured using the Volkswagen Corrosion Bench Test (VCBT) in accordance with PV 1492 (Issue 2012-11) as described hereinafter in the Examples section of this specification;

"TBN" means total base number as measured by ASTM D2896 (mg KOH/g);

"phosphorus content" is measured by ASTM D5185;

"sulfur content" is measured by ASTM D2622; and,

"sulfated ash content" is measured by ASTM D874.

All percentages reported are mass % on an active ingredient basis, i.e., without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural (vegetable, animal or mineral) and synthetic lubricating oils and mixtures thereof.

The oil of lubricating viscosity preferably comprises a Group III base stock. The base stock groups are defined in the American Petroleum Institute (API) publication "Engine Oil Licensing and Certification System", Industry Services Department, Fourteenth Edition, December 1996, Addendum 1, December 1998. Typically, the base stock will have a viscosity preferably of 3-12, more preferably 4-10, most preferably 4.5-8, $mm^2/s$ (cSt) at 100° C.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Preferably, the oil of lubricating viscosity comprises greater than or equal to 10 mass %, more preferably greater than or equal to 20 mass %, even more preferably greater than or equal to 25 mass %, even more preferably greater than or equal to 30 mass %, even more preferably greater than or equal to 40 mass %, even more preferably greater than or equal to 45 mass % of a Group III base stock, based on the total mass of the oil of lubricating viscosity. Even more preferably, the oil of lubricating viscosity comprises greater than 50 mass %, preferably greater than or equal to 60 mass %, more preferably greater than or equal to 70 mass %, even more preferably greater than or equal to 80 mass %, even more preferably greater than or equal to 90 mass % of a Group III base stock, based on the total mass of the oil of lubricating viscosity. Most preferably, the oil of lubricating viscosity consists essentially of a Group III base stock. In some embodiments the oil of lubricating viscosity consists solely of Group III base stock. In the latter case it is acknowledged that additives included in the lubricating oil composition may comprise a carrier oil which is not a Group III base stock. Other oils of lubricating viscosity which may be included in the lubricating oil composition are detailed as follows:

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The oil of lubricating viscosity may also comprise a Group I, Group II, Group IV or Group V base stocks or base oil blends of the aforementioned base stocks.

Preferably, the volatility of the oil of lubricating viscosity or oil blend, as measured by the NOACK test (ASTM D5880), is less than or equal to 16%, preferably less than or equal to 13.5%, preferably less than or equal to 12%, more preferably less than or equal to 10%, most preferably less than or equal to 8%. Preferably, the viscosity index (VI) of the oil of lubricating viscosity is at least 95, preferably at least 110, more preferably at least 120, even more preferably at least 125, most preferably from about 130 to 140.

The oil of lubricating viscosity is provided in a major amount, in combination with a minor amount of additive component (B), as defined herein, and a minor amount of additive component (C), as defined herein, and, if necessary, one or more co-additives, such as described hereinafter, constituting a lubricating oil composition. This preparation may be accomplished by adding the additives directly to the oil or by adding them in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

The lubricating oil compositions of the invention comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

Preferably, the lubricating oil composition of the present invention contains low levels of phosphorus, namely phosphorus up to and including 0.15, more preferably up to 0.12 mass %, even more preferably up to 0.11 mass %, even more preferably not greater than 0.10 mass %, even more preferably up to 0.09 mass %, even more preferably up to 0.08 mass %, even more preferably up to 0.06 mass % of phosphorus, expressed as atoms of phosphorus, based on the total mass of the composition.

Typically, the lubricating oil composition may contain low levels of sulfur. Preferably, the lubricating oil composition contains sulphur up to 0.5, more preferably up to 0.4, even more preferably up to 0.3, most preferably up to 0.2, mass % sulfur, expressed as atoms of sulfur, based on the total mass of the composition.

Typically, the lubricating oil composition may contain low levels of sulphated ash. Preferably, the lubricating oil composition contains sulphated ash up to and including 1.5, more preferably up to 1.2, even more preferably up to 1.1, even more preferably up to 1.0, even more preferably up to 0.8, mass % sulphated ash, based on the total mass of the composition.

Suitably, the lubricating oil composition may have a total base number (TBN) of 4 to 15, preferably 5 to 12. In heavy duty diesel (HDD) engine applications the TBN of the lubricating composition ranges from about 4 to 12, such as 6 to 12. In a passenger car diesel engine lubricating oil composition (PCDO) and a passenger car motor oil for a spark-ignited engine (PCMO), the TBN of the lubricating composition ranges from about 5.0 to about 12.0, such as from about 5.0 to about 11.0.

Preferably, the lubricating oil composition is a multigrade identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of an SAE 5WX or SAE 0WX, wherein X represents any one of 20, 30, 40 and 50. Preferably X is 20, 30 or 40.

Additive Component (B)

Additive component B is formed by reacting an aliphatic polyamine (b1) having at least two carbon atoms and at least two nitrogen atoms with at least one of the nitrogen atoms present in the form of a primary amine group and at least one of the remaining nitrogen atoms present in the form of a primary or secondary amine group, and (b2) an aliphatic hydrocarbyl mono acid or derivative thereof of formula I

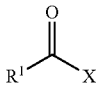

(I)

wherein $R^1$ represents a $C_9$ to $C_{29}$ aliphatic hydrocarbyl group and X represents —OH or a suitable leaving group in a compound of formula I. The reaction is conducted in a manner and under conditions sufficient to react at least one amine group of the aliphatic polyamine (b1) with the aliphatic hydrocarbyl mono acid or derivative thereof (b2) of formula I to form at least one amide and/or imidazoline group.

It will be appreciated that additive component (B) is an ashless organic additive component.

The aliphatic polyamine (b1) contains at least 2, and typically from 2 to 60, preferably 2 to 40, more preferably 2 to 20, even more preferably 4 to 20, even more preferably 4 to 12, especially 6 to 10 total carbon atoms.

The aliphatic polyamine (b1) contains at least two nitrogen atoms, preferably at least 3, more preferably 3 to 15, even more preferably 3 to 12, even more preferably 3 to 9, especially 4 to 6 nitrogen atoms in the molecule.

At least one of the nitrogen atoms in the aliphatic polyamine (b1) is present in the form of a primary amine group and at least one, preferably at least two, of the remaining nitrogen atoms is present in the form of a primary or secondary amine group. Preferably, the aliphatic polyamine (b1) as defined herein, includes at least two nitrogen atoms in the form of a primary amine group.

The following amine description is subject to the above constraints regarding carbon and nitrogen atom content, and the variable groups for the following formulae are to be selected in conformance with such constraints. Additionally, the following amine description is also limited to amines which must have at least one nitrogen atom present in the form of a primary amine group and at least one of the remaining nitrogen atoms present in the form of a primary or secondary amine group.

Suitably, the aliphatic polyamine (b1) is an aliphatic hydrocarbyl polyamine, an acyclic aliphatic hydrocarbyl polyamine. Preferably, the aliphatic polyamine (b1) is an unsubstituted straight or branched chain acyclic aliphatic hydrocarbyl polyamine or a straight or branched chain acyclic aliphatic hydrocarbyl polyamine which is substituted with one or more groups selected from hydroxy groups; alkoxy groups, amide groups, and nitrile groups. A particularly preferred aliphatic polyamine (b1) is an unsubstituted straight or branched chain acyclic aliphatic hydrocarbyl polyamine, particularly an unsubstituted straight chain acyclic aliphatic hydrocarbyl polyamine. Suitably, the aliphatic hydrocarbyl group of the polyamine (b1) may be saturated or unsaturated, preferably the aliphatic hydrocarbyl group is a saturated aliphatic hydrocarbyl group, such as an alkylene group e.g. an ethylene or propylene group. Most preferably, the aliphatic hydrocarbyl group of the aliphatic polyamine (b1) includes only carbon and hydrogen atoms. A particularly preferred aliphatic polyamine (b1) comprises a polyalkylene polyamine, more preferably a polyethylene polyamine or a polypropylene polyamine, especially a polyethylene polyamine.

When the aliphatic polyamine (b1) is a polyalkylene polyamine, the polyalkylene polyamine contains at least 3, more preferably 3 to 15, even more preferably 3 to 12, even more preferably 3 to 9, especially 4 to 6 nitrogen atoms in the molecule. Preferably, the polyalkylene polyamine includes at least 2 nitrogen atoms in the form of a primary amine group, more preferably the polyalkylene polyamine includes at least 2 nitrogen atoms in the form of a primary amine group and at least one of the remaining nitrogen atoms in the form of a secondary amine group.

Suitable, polyalkylene polyamines which the aliphatic polyamine (b1) may represent include compounds of formula II—

(II)

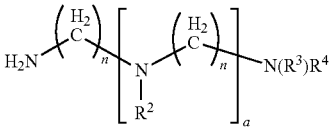

wherein: each $R^2$ independently represents at each occurrence hydrogen, $C_1$ to $C_{12}$ alkyl group, $C_2$ to $C_6$ alkenyl group or $C_1$ to $C_{12}$ alkyl amine; $R^3$ and $R^4$ each independently represent hydrogen, $C_1$ to $C_{12}$ alkyl group, $C_2$ to $C_6$ alkenyl group or $C_1$ to $C_{12}$ alkyl amine; a is an integer from 0 to 10; each n independently represents at each occurrence an integer from 2 to 6; and, with the proviso that when a is 0 then at least one of $R^3$ or $R^4$ represents hydrogen.

Preferably, each $R^2$ in a compound of formula II independently represents at each occurrence hydrogen, $C_1$ to $C_{12}$ alkyl group or $C_1$ to $C_{12}$ alkyl amine such as —$(CH_2)$—$N(R^3)R^4$ where n, $R^3$ and $R^4$ are as defined herein. More preferably, each $R^2$ in a compound of formula II independently represents at each occurrence hydrogen or $C_2$ to $C_6$ alkyl amine, for example —$(CH_2)_nN(R^3)R^4$ where n is 2 to 6 and $R^3$ and $R^4$ are as defined herein. Even more preferably, each $R^2$ in a compound of formula II independently represents at each occurrence hydrogen or $C_2$ to $C_4$ alkyl amine, for example —$(CH_2)_nN(R^3)R^4$ where n is 2 to 4 and $R^3$ and $R^4$ are as defined herein. Most preferably, each $R^2$ in a compound of formula II independently represents at each occurrence hydrogen or —$C_2H_4NH_2$ (i.e. aminoethyl).

Preferably, $R^3$ in a compound of formula II represents hydrogen or $C_1$ to $C_6$ alkyl group, especially hydrogen.

Preferably, $R^4$ in a compound of formula II represents hydrogen or $C_1$ to $C_6$ alkyl group, especially hydrogen.

Preferably, a in a compound of formula II is an integer from 1 to 6, more preferably 2 to 4, even more preferably 2 or 3, especially 3.

Preferably, each n in a compound of formula II independently represents at each occurrence an integer from 2 to 4.

Preferably, each n in a compound of formula II is identical.

Most preferably each n in a compound of formula II is 2.

Non-limiting examples of suitable aliphatic polyamine compounds (b1) include: polyethylene polyamines such as diethylene triamine; triethylene tetramine; tetraethylene pentamine; pentaethlyene hexamine; $N^2$-(aminoethyl)triethylene tetramine; and, polypropylene polyamines such as di-(1,2-propylene)triamine; di(1,3-propylene)triamine; and, mixtures thereof. Highly preferred aliphatic polyamine compounds (b1) are the polyethylene polyamines such as diethylene triamine; triethylene tetramine; tetraethylene pentamine; pentaethlyene hexamine; $N^2$-(aminoethyl)triethylene tetramine and mixtures thereof. The most preferred aliphatic polyamine compounds (b1) are tetraethylene pentamine and $N^2$-(aminoethyl)triethylene tetramine and mixtures thereof, especially tetraethylene pentamine.

Commercial mixtures of amine compounds may advantageously be used. For example, one process for preparing polyalkylene polyamines involves the reaction of an alkylene dihalide (e.g. ethylene dichloride or propylene dichloride) with ammonia which may result in a complex mixture wherein pairs of nitrogen atoms are joined by alkylene groups, forming such compounds as tetraethylene pentamine, $N^2$-(aminoethyl)triethylene tetramine and the isomeric piperazines, such as N-(2-(4-(2-aminoethyl)piperazin-1-yl)ethyl)ethanediamine and $N^1$-(2-aminoethyl)-$N^2$-(2-(piperazin-1-yl)ethyl)ethane-1,2-diamine.

A highly preferred aliphatic polyamine compound (b1) is tetraethylene pentamine. The tetraethylene pentamine may be employed singly or alternatively may form part of a mixture of amines which includes in addition $N^2$-(aminoethyl)triethylene tetramine and the isomeric piperazines, such as N-(2-(4-(2-aminoethyl)piperazin-1-yl)ethyl)ethanediamine and $N^1$-(2-aminoethyl)-$N^2$-(2-(piperazin-1-yl)ethyl)ethane-1,2-diamine.

Suitably, when the aliphatic polyamine compound (b1) comprises a mixture of at least two or more aliphatic polyamines (b1) as defined hereinbefore, such a mixture may include tetraethylene pentamine and $N^2$-(aminoethyl)triethylene tetramine.

The aforementioned aliphatic polyamine (b1) is reacted with an aliphatic hydrocarbyl mono acid or derivative thereof (b2) of formula I to form additive component (B):

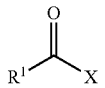

(I)

wherein $R^1$ represents a $C_9$ to $C_{29}$ aliphatic hydrocarbyl group and X represents —OH or a suitable leaving group in a compound of formula I. The reaction is conducted in a manner and under conditions sufficient to react at least one amine group of the aliphatic polyamine (b1) with the aliphatic hydrocarbyl mono acid or derivative thereof (b2) of formula I to form at least one amide and/or imidazoline group.

Suitable leaving groups which X may represent include —OC(O)$R^1$, —$OR^5$ or halo wherein $R^1$ represents a $C_9$ to $C_{29}$ aliphatic hydrocarbyl group as defined herein and $R^5$ represents a $C_1$ to $C_8$ aliphatic hydrocarbyl group. More preferably, X represents —OH or —OC(O)$R^1$ i.e. the $C_9$ to $C_{29}$ aliphatic hydrocarbyl monocarboxylic acid or anhydride derivative thereof. Most preferably, X represents —OH in a compound of formula I, i.e. the compounds of formula I represent a $C_9$ to $C_{29}$ aliphatic hydrocarbyl monocarboxylic acid having a terminal carboxylic acid group.

$R^1$ in a compound of formula I represents a $C_9$ to $C_{29}$ aliphatic hydrocarbyl group, preferably a $C_{11}$ to $C_{23}$ aliphatic hydrocarbyl group, even more preferably a $C_{15}$ to $C_{20}$ aliphatic hydrocarbyl group, even more preferably a $C_{16}$ to $C_{18}$ aliphatic hydrocarbyl group, especially a $C_{17}$ aliphatic hydrocarbyl group.

Suitably, the aliphatic hydrocarbyl group which $R^1$ represents in a compound of formula I may be saturated or unsaturated, acylic or part acylic and part cyclic, or straight chain or branched chain.

Preferably, the $C_9$ to $C_{29}$ aliphatic hydrocarbyl group, as defined herein, which $R^1$ represents in a compound of formula I is a saturated aliphatic hydrocarbyl group, especially an alkyl group.

Preferably, the $C_9$ to $C_{29}$ aliphatic hydrocarbyl group, as defined herein, which $R^1$ represents in a compound of formula I is an acyclic aliphatic hydrocarbyl group.

Preferably, the $C_9$ to $C_{29}$ aliphatic hydrocarbyl group, as defined herein, which $R^1$ represents in a compound of formula I is a branched chain aliphatic hydrocarbyl group.

Preferably, $R^1$ in compound of formula I represents a $C_9$ to $C_{29}$ saturated acyclic branched chain aliphatic hydrocarbyl group, more preferably an acyclic branched chain $C_9$ to $C_{29}$ alkyl group, even more preferably an acyclic branched chain $C_{11}$ to $C_{23}$ alkyl group, even more preferably an acyclic branched chain $C_{15}$ to $C_{20}$ alkyl group, even more preferably an acyclic branched chain $C_{16}$ to $C_{18}$ alkyl group, most preferably an acyclic branched chain $C_{1-7}$ alkyl group.

Representative examples of a compound of formula I include the monocarboxylic acids (i.e. fatty acids) such as: nonanoic (perlargonic); decanoic (capric); undecanoic; dodecanoic (lauric); tridecanoic; tetradecanoic (myristic); pentadecanoic; heaxdecanoic (palmitic); heptadecanoic (margaric); octadecanoic (stearic and isostearic); nonadecanoic; eicosanic (arachidic); docosanoic (behenic); tetracosanoic (lignoceric); hexacosanoic (cerotic); nonenoic; decenoic; undecenoic; dodecenoic; tridecenoic; pentadecenoic; hexadecenoic; heptadecenoic; octadecenoic (oleic); and, mixtures thereof.

The highly preferred mono-carboxylic acids which the aliphatic hydrocarbyl mono acid of formula I may represent include stearic acid, isostearic acid and mixtures thereof. The most preferred compound of formula I is isostearic acid (i.e. 16-methyl heptadecanoic acid). Suitably, the most preferred additive component (B) is the reaction product of isostaeric acid and tetraethylene pentamine.

The reaction of the aliphatic hydrocarbyl mono acid or derivative thereof (b2) of formula I with the aliphatic polyamine (b1) to form the additive component (B) is typically carried out at an elevated temperature, for approximately 2 to 10 hours, and optionally in the presence of a suitable solvent, e.g. toluene. Typically the reaction is performed at a temperature of between 100° C. to 250° C., more preferably 120° C. to 200° C., and any water produced during the condensation reaction (i.e. when X represents —OH in a compound of formula I) is removed, for example, using a Dean Stark apparatus. As a result of water formed in-situ by the amidation reaction, most, if not all, of the imidazoline groups are intentionally hydrolysed to primary amine groups. Suitable methods for reacting a compound of formula I with the aliphatic polyamine (b1) to form the additive component (B) are described in U.S. Pat. No. 5,395,539 and U.S. Pat. No. 4,705,643.

Accordingly, during reaction of the aliphatic hydrocarbyl mono acid or derivative thereof (b2) of formula I with the aliphatic polyamine (b1) a sufficient amount of the compound of formula I is employed to impart oil-solubility or oil-dispersibility to the resulting aliphatic polyamide (B). Suitably, the molar ratio of the aliphatic hydrocarbyl mono acid or derivative thereof (b2) of formula I reactant to the aliphatic polyamine (b1) reactant is from about 2 to 10, preferably 3 to 10, most preferably 3 to 5, especially 3 to 4 molar equivalents of the compound of formula I reacted per mole of aliphatic polyamine (b1). Suitably, a sufficient amount of the aliphatic hydrocarbyl mono acid or derivative thereof (b2) of formula I is employed so that the resultant aliphatic polyamide (B) has at least one reactive amine group, i.e. primary or secondary amine group in the resultant aliphatic polyamide (B). Thus, for example, when the most preferred aliphatic hydrocarbyl mono acid (b2) of formula I when X represents —OH, i.e. isostearic acid, is reacted with the most preferred aliphatic polyamine (b1), i.e. tetraethylene pentamine (containing 5 reactive amine groups), then three molar equivalents of isostearic acid are preferably reacted per mole of tetraethylene pentamine, with the condensation reaction yielding a product mixture but with condensation preferentially taking place at the two primary amine groups and one of the secondary amine groups of the tetraethylene pentamine.

Thus, for example, the reaction between the most preferred aliphatic hydrocarbyl mono acid (b2) of formula I when X represents —OH, i.e. isostearic acid, and the most preferred aliphatic polyamine (b1), i.e. tetraethylene pentamine, may be represented by the following equation:

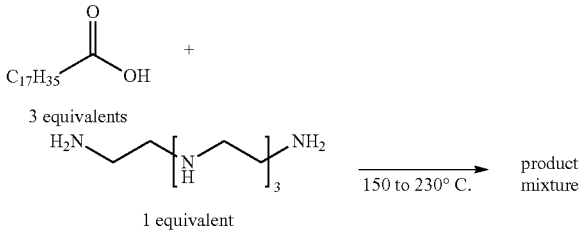

where "product mixture" represents a mixture of products including those of formulae III, IV, V, VI and VII below:

(III)

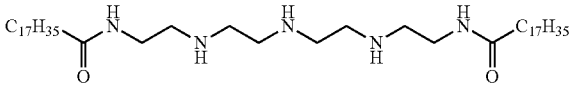

(IV)

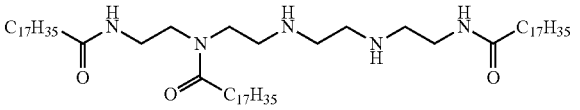

(V)

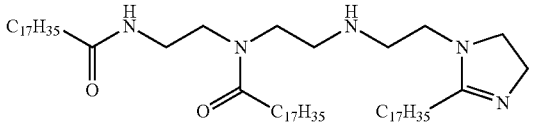

(VI)

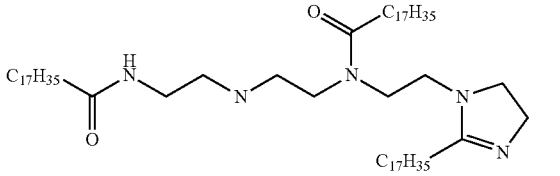

(VII)

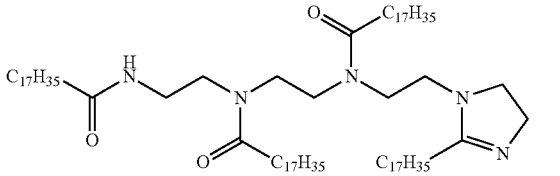

As a result of water formed insitu by the amidation reaction, most, if not all, of the imidazoline groups of structures V, VI and VII are intentionally hydrolysed to amine groups.

Suitably, the aliphatic polyamide (B) is present in amount of 0.01 to 5.0, preferably 0.01 to 2.0, more preferably 0.01 to 1.5, even more preferably 0.05 to 1.5, even more preferably 0.05 to 1.0, even more preferably 0.05 to 0.5, most preferably 0.1 to 0.5, mass % based on the total mass % of the lubricating oil composition.

Additive Component (C)

Additive component (C) is a primary amide of formula $R^6C(O)NH_2$ wherein $R^6$ represents a $C_9$ to $C_{29}$ aliphatic hydrocarbyl group. Typically, such additives are employed in lubricating oil compositions as a friction reducing additive to improve fuel economy performance. Suitably, such additives are ashless organic additive components and may be prepared by routine chemical synthetic techniques, for example by ammonolysis of the corresponding ester, acid chloride or acid anhydride.

$R^6$ in a compound of formula $R^6C(O)NH_2$ represents a $C_9$ to $C_{29}$ aliphatic hydrocarbyl group, preferably a $C_{11}$ to $C_{23}$ aliphatic hydrocarbyl group, even more preferably a $C_{15}$ to $C_{20}$ aliphatic hydrocarbyl group, even more preferably a $C_{16}$ to $C_{18}$ aliphatic hydrocarbyl group, especially a $C_{17}$ aliphatic hydrocarbyl group.

Suitably, the aliphatic hydrocarbyl group which $R^6$ represents in a compound of formula $R^6C(O)NH_2$ may be saturated or unsaturated, acylic or part acylic and part cyclic, or straight chain or branched chain.

Preferably, the $C_9$ to $C_{29}$ aliphatic hydrocarbyl group, as defined herein, which $R^6$ represents in a compound of formula $R^6C(O)NH_2$ is an unsaturated aliphatic hydrocarbyl group, more preferably an alkenyl group, especially an alkenyl group having a single double bond.

Preferably, the $C_9$ to $C_{29}$ aliphatic hydrocarbyl group, as defined herein, which $R^6$ represents in a compound of formula $R^6C(O)NH_2$ is an acyclic aliphatic hydrocarbyl group.

Preferably, the $C_9$ to $C_{29}$ aliphatic hydrocarbyl group, as defined herein, which $R^6$ represents in a compound of formula $R^6C(O)NH_2$ is a straight chain aliphatic hydrocarbyl group.

Preferably, $R^6$ in compound of formula $R^6C(O)NH_2$ represents a $C_9$ to $C_{29}$ unsaturated acyclic straight chain aliphatic hydrocarbyl group, more preferably an acyclic straight chain $C_9$ to $C_{29}$ alkenyl group having a single double bond, even more preferably an acyclic straight chain $C_{11}$ to $C_{23}$ alkenyl group having a single double bond, even more preferably an acyclic straight chain $C_{15}$ to $C_{20}$ alkenyl group having a single double bond, even more preferably an acyclic straight chain $C_{16}$ to $C_{18}$ alkenyl group having a single double bond, most preferably an acyclic straight chain $C_{1-7}$ alkenyl group having a single double bond.

By the term "straight chain" in respect of an alkenyl group, such as straight chain $C_9$ to $C_{29}$ alkenyl group having a single double bond, we mean that each carbon atom of each carbon to carbon double bond which is present within the chain has a hydrogen, preferably a single hydrogen, atom attached thereto. Suitably, each alkenyl group may independently be in the cis (Z) or trans (E) configuration. Preferably, each alkenyl group is present in the cis (Z) configuration.

Representative examples of additive component (C) of formula $R^6C(O)NH_2$ where $R^6$ represents a saturated $C_9$ to $C_{29}$ aliphatic hydrocarbyl group include perlargonyl amide, capryl amide, lauryl amide, myristyl amide, palmityl amide, margaryl amide, stearyl amide, isostearyl amide, arachidyl amide, behenyl amide, lignoceryl amide and cerotyl amide.

Representative examples of additive component (C) of formula $R^6C(O)NH_2$ where $R^6$ represents the more preferred unsaturated $C_9$ to $C_{29}$ aliphatic hydrocarbyl group include nonenyl amide, decenyl amide, undecenyl amide, tridecenyl amide, tetradecenyl amide, pentadecenyl amide, hexadecenyl amide, heptadecenyl amide, octadecenyl amide (including oleamide), nonadecenyl amide, icosenyl amide, docosenyl amide, tricosenyl amide, tetracosenyl amide, pentacosenyl amide, hexacosenyl amide, heptacosenyl amide, octacosenyl amide and nonacosenyl amide.

The most preferred additive component (C) is octadecenyl amide, especially oleamide.

Suitably, additive component (C) is present in amount of 0.01 to 5.0 (e.g. 0.1 to 5.0), preferably 0.01 to 2.0, more preferably 0.05 to 1.5 (e.g. 0.1 to 1.5), even more preferably 0.05 to 1.0, most preferably 0.1 to 1.0 (e.g. 0.2 to 1.0), mass % based on the total mass % of the lubricating oil composition.

Engines

The lubricating oil compositions of the invention may be used to lubricate mechanical engine components, particularly in internal combustion engines, e.g. spark-ignited or compression-ignited two- or four-stroke reciprocating engines, by adding the composition thereto. The engines may be conventional gasoline or diesel engines designed to be powered by gasoline or petroleum diesel, respectively; alternatively, the engines may be specifically modified to be powered by an alcohol based fuel or biodiesel fuel. Preferably, the lubricating oil compositions are crankcase lubricants.

Preferably, the lubricating oil composition is for use in the lubrication of a spark-ignited internal combustion engine, especially a spark-ignited internal combustion engine which is fuelled with an alcohol based fuel, such as an ethanol based fuel, more preferably a bioalcohol based fuel, especially bioethanol. Such engines include passenger car spark-ignited internal combustion engines. More preferably, the lubricating oil composition is for use in the lubrication of the crankcase of the aforementioned engines.

When the lubricating oil composition, such as a crankcase lubricant, is used in the lubrication of a spark-ignited or compression-ignited internal combustion engine which is fuelled at least in part with a biofuel, the lubricant during operation of the engine becomes contaminated with biofuel and decomposition products thereof. Thus according to a preferred aspect of the present invention, the lubricating oil composition of the present invention comprises at least 0.3, preferably at least 0.5, more preferably at least 1, even more preferably at least 5, even more preferably at least 10, even more preferably at least 15, even more preferably at least 20, mass % of biofuel and/or a decomposition product thereof. Although the lubricating oil composition may comprise up to 50 mass % of biofuel and/or a decomposition product thereof, preferably it includes less than 35, more preferably less than 30, mass % of biofuel and/or a decomposition product thereof.

The biofuel comprises an alcohol based fuel in the case of spark-ignited internal combustion engines, preferably a bioalcohol fuel, especially bioethanol fuel.

The biofuel comprises biodiesel in the case of compression ignited internal combustion engines.

Biofuels

The term "biofuel" refers to a biodiesel fuel, a bioalcohol fuel and an alcohol based fuel as defined herein (i.e. a fuel that does not consist of solely petroleum gasoline or petroleum diesel fuel). Biofuels include fuels that are produced from renewable biological resources and include biodiesel fuel as defined herein and bioethanol fuel which may be derived from fermented sugar. The term biofuel also embraces an "alcohol based fuel", such as "ethanol based fuel", irrespective of the source of the alcohol (i.e. the alcohol may be derived from a renewable biological source or a non-renewable source, such as petroleum).

Alcohol Based Fuels

Alcohol based fuels are employed in spark-ignited internal combustion engines. The alcohol based fuel may include one or more alcohols selected from methanol, ethanol, propanol and butanol. The alcohol may be derived from a renewable biological source or a non-renewable source, such as petroleum. The alcohol based fuel may comprise 100% by volume of one or more alcohols (i.e. pure alcohol). Alternatively the alcohol based fuel may comprise a blend of an alcohol and petroleum gasoline; suitable blends include 5, 10, 15, 20, 25, 30, 35, 40, 50, 60, 70, 80, 85, and 90, vol. % of the alcohol, based on the total volume of the alcohol and gasoline blend.

Preferably, the alcohol based fuel comprises an ethanol based fuel. More preferably, the alcohol based fuel comprises a bioalcohol fuel, especially a bioethanol fuel.

The bioethanol fuel comprises ethanol derived from a renewable biological source (i.e. bioethanol), preferably ethanol derived solely from a renewable biological source. The bioethanol may be derived from the sugar fermentation of crops such as corn, maize, wheat, cord grass and sorghum plants. The bioethanol fuel may comprise 100% by volume bioethanol (designated as E100); alternatively, the bioethanol fuel may comprise a blend of bioethanol and petroleum gasoline. The bioethanol fuel blend may have the designation "Exx" wherein xx refers to the amount of E100 bioethanol in vol. %, based on the total volume of the bioethanol fuel blend. For example, E10 refers to a bioethanol fuel blend which comprises 10 volume % E100 bioethanol fuel and 90 volume % of petroleum gasoline. For the avoidance of doubt, the term "bioethanol fuel" includes pure bioethanol fuel (i.e. E100) and bioethanol fuel blends comprising a mixture of bioethanol fuel and petroleum gasoline fuel.

Typically, the bioethanol fuel comprises E100, E95, E90, E85, E80, E75, E70, E65, E60, E55, E50, E45, E40, E35, E30, E25, E20, E15, E10, E8, E6 or E5. Highly preferred blends include E85 (ASTM D5798 (USA)), E10 (ASTM D4806 (USA)) and E5 (EN 228:2004 (Europe)).

Biodiesel Fuels

The biodiesel fuel comprises at least one alkyl ester, typically a mono-alkyl ester, of a long chain fatty acid derivable from vegetable oils or animal fats. Preferably, the biodiesel fuel comprises one or more methyl or ethyl esters of such long chain fatty acids, especially one or more methyl esters.

The long chain fatty acids typically comprise long chains which include carbon, hydrogen and oxygen atoms. Preferably, the long chain fatty acids include from 10 to 30, more preferably 14 to 26, most preferably 16 to 22, carbon atoms. Highly preferred fatty acids include palmitic acid, stearic acid, oleic acid and linoleic acid.

The biodiesel fuel may be derived from the esterification or transesterification of one or more vegetable oils and animal fats, such as corn oil, cashew oil, oat oil, lupine oil, kenaf oil, calendula oil, cotton oil, hemp oil, soybean oil, linseed oil, hazelnut oil, euphorbia oil, pumpkin seed oil, palm oil, rapeseed oil, olive oil, tallow oil, sunflower oil, rice oil, sesame oil or algae oil. Preferred vegetable oils include palm oil, rapeseed oil and soybean oil.

Generally, a pure biodiesel fuel that meets the ASTM D6751-08 standard (USA) or EN 14214 standard (European) specifications is designated as B100. A pure biodiesel fuel may be mixed with a petroleum diesel fuel to form a biodiesel blend which may reduce emissions and improve engine performance. Such biodiesel blends are given a designation "Bxx" where xx refers to the amount of the B100 biodiesel in volume %, based on the total volume of the biodiesel blend. For example, B10 refers to a biodiesel blend which comprises 10 volume % B100 biodiesel fuel and 90 volume % of petroleum diesel fuel. For the avoidance of doubt, the term "biodiesel fuel" includes pure biodiesel fuel (i.e. B100) and biodiesel fuel blends comprising a mixture of biodiesel fuel and petroleum diesel fuel.

Typically, the biodiesel fuel comprises a B100, B95, B90, B85, B80, B75, B70, B65, B60, B55, B50, B45, B40, B35, B30, B25, B20, B15, B10, B8, B6, B5, B4, B3, B2 or B1. Preferably, the biodiesel fuel comprises a B50 designation or lower, more preferably a B5 to B40, even more preferably B5 to B40, most preferably B5 to B20.

Co-Additives

Co-additives, with representative effective amounts, that may also be present, different from additive component (B), are listed below. All the values listed are stated as mass percent active ingredient.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-6 | 0.01-4 |
| Mineral or Synthetic Base Oil | Balance | Balance |

(1) Viscosity Modifiers are Used Only in Multi-Grade Oils.

The final lubricating oil composition, typically made by blending the or each additive into the base oil, may contain from 5 to 25, preferably 5 to 18, typically 7 to 15, mass % of the co-additives, the remainder being oil of lubricating viscosity.

The above mentioned co-additives are discussed in further detail as follows; as is known in the art, some additives can provide a multiplicity of effects, for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", as mentioned above, being non-metallic organic materials that form substantially no ash on combustion, in contrast to metal-containing, and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025) fluorinated and oxylated. For example, boration may be accomplished by treating an acyl nitrogen-containing dispersant with a boron compound selected from boron oxide, boron halides, boron acids and esters of boron acids.

Preferably, the lubricating oil composition includes an oil-soluble boron containing compound, especially a borated dispersant. Preferably, the borated dispersant comprises an ashless nitrogen containing borated dispersant, such as a borated polyalkenyl succinimide, especially a borated polyisobutenyl succinimide.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN of 150 or greater, and typically of from 250 to 500 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g. sodium, potassium, lithium, calcium and magnesium. The most commonly-used metals are calcium and magnesium, which may both be present in detergents used in a lubricant, and mixtures of calcium and/or magnesium with sodium.

Particularly preferred metal detergents are neutral and overbased alkali or alkaline earth metal salicylates having a TBN of from 50 to 450, preferably a TBN of 50 to 250. Highly preferred salicylate detergents include alkaline earth metal salicylates, particularly magnesium and calcium, especially, calcium salicylates. Preferably, the alkali or alkaline earth metal salicylate detergent is the sole detergent in the lubricating oil composition.

Alterantive preferred metal detergents are neutral and overbased alkali or alkaline earth metal sulphonates and/or neutral and overbased alkali or alkaline earth metal phenates, especially neutral and overbased calcium and magnesium sulphonates and/or neutral and overbased calcium phenates.

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenum compounds useful in all aspects of the present invention is tri-nuclear molybdenum compounds of the formula $Mo_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.01 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricating oil composition. For some applications, the molybdenum is present in an amount of greater than 500 ppm.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth. They may be classified as radical scavengers (e.g. sterically hindered phenols, secondary aromatic amines, and organo-copper salts); hydroperoxide decomposers (e.g., organosulfur and organophosphorus additives); and multi-functionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulfur-containing antioxidants, aromatic amine-containing antioxidants, hindered phenolic antioxidants, dithiophosphates derivatives, metal thiocarbamates, and molybdenum-containing compounds. Preferred anti-oxidants are aromatic amine-containing antioxidants, molybdenum-containing compounds and mixtures thereof, particularly aromatic amine-containing antioxidants. Preferably, an antioxidant is present in the lubricating oil composition.

Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts wherein the metal may be an alkali or alkaline earth metal, or aluminium, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred dihydrocarbyl dithiophosphate metal salts are zinc dihydrocarbyl dithiophosphates (ZDDP) which are oil-soluble salts of dihydrocarbyl dithiophosphoric acids and may be represented by the following formula:

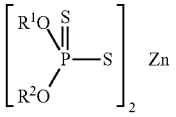

wherein $R^1$ and $R^2$ may be the same or different hydrocarbyl radicals containing from 1 to 18, preferably 2 to 12, carbon atoms and include radicals such as alkyl, alkenyl, aryl, arylalkyl, alkaryl and cycloaliphatic radicals. Particularly preferred as $R^1$ and $R^2$ groups are alkyl groups of 2 to 8 carbon atoms, especially primary alkyl groups (i.e. $R^1$ and $R^2$ are derived from predominantly primary alcohols). Thus, the radicals may, for example, be ethyl, n-propyl, i-propyl, n-butyl, iso-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R^1$ and $R^2$) in the dithiophosphoric acid will generally be about 5 or greater. Preferably, the zinc dihydrocarbyl dithiophosphate comprises a zinc dialkyl dithiophosphate.

Preferably, the lubricating oil composition contains an amount of dihydrocarbyl dithiophosphate metal salt that introduces 0.02 to 0.10 mass %, preferably 0.02 to 0.09 mass %, preferably 0.02 to 0.08 mass %, more preferably 0.02 to 0.06 mass % of phosphorus into the composition.

To limit the amount of phosphorus introduced into the lubricating oil composition to no more than 0.10 mass %, the dihydrocarbyl dithiophosphate metal salt should preferably be added to the lubricating oil compositions in amounts no greater than from 1.1 to 1.3 mass % (a.i.), based upon the total mass of the lubricating oil composition.

Examples of ashless anti-wear agents include 1,2,3-triazoles, benzotriazoles, sulfurised fatty acid esters, and dithiocarbamate derivatives.

Rust and corrosion inhibitors serve to protect surfaces against rust and/or corrosion. As rust inhibitors there may be mentioned non-ionic polyoxyalkylene polyols and esters thereof, polyoxyalkylene phenols, thiadiazoles and anionic alkyl sulfonic acids.

Pour point depressants, otherwise known as lube oil flow improvers, lower the minimum temperature at which the oil will flow or can be poured. Such additives are well known. Typical of these additive are $C_8$ to $C_{18}$ dialkyl fumerate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It is obtained by reacting an alkylene oxide with an adduct obtained by reaction of a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricating oil. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

The additives may be incorporated into an oil of lubricating viscosity (also known as a base oil) in any convenient way. Thus, each additive can be added directly to the oil by dispersing or dissolving it in the oil at the desired level of concentration. Such blending may occur at ambient temperature or at an elevated temperature. Typically an additive is available as an admixture with a base oil so that the handling thereof is easier.

When a plurality of additives are employed it may be desirable, although not essential, to prepare one or more additive packages (also known as additive compositions or concentrates) comprising additives and a diluent, which can be a base oil, whereby the additives, with the exception of viscosity modifiers, multifunctional viscosity modifiers and pour point depressants, can be added simultaneously to the base oil to form the lubricating oil composition. Dissolution of the additive package(s) into the oil of lubricating viscosity may be facilitated by diluent or solvents and by mixing accompanied with mild heating, but this is not essential. The additive package(s) will typically be formulated to contain the additive(s) in proper amounts to provide the desired concentration in the final formulation when the additive package(s) is/are combined with a predetermined amount of oil of lubricating viscosity. Thus, one or more detergents may be added to small amounts of base oil or other compatible solvents (such as a carrier oil or diluent oil) together with other desirable additives to form additive packages containing from 2.5 to 90, preferably from 5 to 75, most preferably from 8 to 60, mass %, based on the mass of the additive package, of additives on an active ingredient basis in the appropriate proportions. The final formulations may typically contain 5 to 40 mass % of the additive package(s), the remainder being oil of lubricating viscosity.

Preferably, the additive components (B) and (C) form part of an additive package which also includes a diluent, preferably a base stock, and one or more co-additives in a minor amount, other than additive components (B) and (C), selected from ashless dispersants, metal detergents, corrosion inhibitors, antioxidants, antiwear agents, friction modifiers, demulsifiers and antifoam agents; the additive package being added to the oil of lubricating viscosity.

EXAMPLES

The invention will now be particularly described in the following examples which are not intended to limit the scope of the claims hereof.

Corrosion Control: Volkswagen Corrosion Bench Test (VCBT)

Corrosion control is measured using the Volkswagen Corrosion Bench Test (VCBT) in accordance with PV 1492 (Issue 2012-11). This test method simulates the corrosion of iron and alloys thereof, such as steel found in the metal crankshaft, in lubricants contaminated with an alcohol based fuel; the corrosion process under investigation being induced by lubricant chemistry rather than lubricant degradation or contamination.

The test specimen is a quarter of a bearing journal of the crankshaft (Mat. No. 030.105.101.BG). The running surface of the quarter element serves to evaluate the protective effect of the lubricating oil which is to be tested. The test specimen is cleaned with naphtha in an ultrasonic bath and then preconditioned by immersing it fully in fresh oil and heating in an oven at 60° C. for 1 hour.

The test lubricating oil composition contaminated with ethanol and a decomposition product thereof (i.e. acetic acid and water) is prepared by adding an ethanol-water mixture (9 ml, ethanol:water 2:1) to the lubricating oil composition (91 ml) with stirring and then stirring the resulting mixture at 30 to 40° C. for 30 minutes. Thereafter, a proportion of the lubricating oil composition (50 ml) is transferred to the testing vessel and acetic acid (2.5%, 1.25 ml) added thereto and the resulting mixture homogenised on a shaker for 3 minutes.

The preconditioned test specimen, without cooling, is then transferred to and fully immersed in the test lubricating oil composition and the testing vessel sealed air-tight and stored for 7 days (168 hours) at room temperature (23±2° C.) and at 50±5% air humidity. After which, the test specimen is removed, wiped off (i.e. cleaned with naphtha) and visually inspected for signs of corrosion. The amount of corrosion on the test specimen is rated according to the following rating scale:

0—Pass—no corrosion/no change

1—Pass—no signs of corrosion; dull but no change in surface colour

2—Fail—slight corrosion, on parts or over the whole surface, discolouration noticeable 3—Fail—heavy corrosion, evenly across the surface, discolouration dark to black Unless otherwise specified, all of the additives described in the Examples are available as standard additives from lubricant additive companies such as Infineum UK Ltd, Lubrizol Corporation and Afton Chemicals Corporation, for example. The reaction product of isostearic acid and tetraethylene pentamine (additive component (B)) was obtained from KMCO and oleamide (additive component (C)) was obtained from Croda Chemicals.

Examples 1 to 5

A series of 5W-30 and 5W-40 multi-grade lubricating oil compositions, as detailed in Table 1, were prepared by admixing a Group III base stock with known additives including an optional borated dispersant, non-borated ashless dispersants, ZDDP, an aminic and/or a phenolic antioxidant, a viscosity index improver concentrate, an optional oleamide ashless friction modifier, an optional organo-molybdenum friction modifier, an anti-foam agent, lubricant oil flow improver (LOFT) and tackifier. The lubricating oil compositions included various different detergent systems selected from an overbased calcium salicylate detergent (TBN 350 mgKOH/g), a neutral calcium salicylate detergent (TBN 64 mgKOH/ g), an overbased calcium salicylate detergent (TBN 217 mgKOH/g), an overbased magnesium salicylate detergent (TBN 345 mgKOH/g), an overbased calcium sulfonate detergent (TBN 295 mgKOH/g), an overbased magnesium sulphonate detergent (TBN 395 mgKOH/g) and an overbased sulphurised calcium phenate detergent (TBN 135 mgKOH/g) and combinations thereof. All additives listed in Table 1 are based on mass % active ingredient with the exception of the viscosity modifier which is based on mass % of the viscosity modifier concentrate.

Lubricants 1 to 5 of the invention (Lube 1, Lube 2, Lube 3, Lube 4 and Lube 5, respectively), as detailed in Table 1, included both additive component (B), being the condensation product of 3 molar equivalents of isostearic acid and 1 molar equivalent of tetraethylene pentamine, and additive component (C), namely oleamide ashless friction modifier. The Reference Lubricants (Ref 1A, Ref 1B, Ref 2, Ref 3 and Ref 4), as detailed in Table 1, are either devoid of both additive components (B) and (C) (Ref 1A and Ref 4), include only additive component (B) (Ref 1B and Ref 2), or include only additive component (C) (Ref 3).

The ability of each lubricant, as detailed in Table 1, to control corrosion when contaminated with an ethanol based fuel and decomposition product thereof (i.e. acetic acid) was evaluated using the Volkswagen Corrosion Bench Test (VCBT) as described hereinbefore.

A comparison of the VCBT results of Reference Lubricants TA and 1B with that of Lubricant 1 of the invention demonstrate: (i) in the absence of both additive components (B) and (C) (Ref 1A) the lubricant displays extremely poor corrosion control and fails the VCBT; (ii) with the inclusion of only additive component (B) (Ref 1B) the lubricant still fails the VCBT though corrosion control improves slightly compared to Ref 1A; and, (iii) with the inclusion of both additive components (B) and (C) (Lube 1) corrosion control improves significantly and the lubricant exhibits a strong pass in the VCBT. The requirement of having both additive components (B) and (C) in the lubricant to exhibit a strong pass in the VCBT is also demonstrated by comparing the VCBT result of Reference Lubricant 2 with that of Lubricant 2 of the invention.

A comparison of the VCBT result of Reference Lubricant 3 with that of Lubricant 3 of the invention demonstrates again that it is necessary to include both additive components (B) and (C) in the lubricant (Lube 3) to exhibit a strong pass in the VCBT, as the inclusion of only additive component (C) (Ref 3) provides a lubricant which fails the corrosion test.

A comparison of the VCBT results of Reference Lubricant 4 with Lubricants 4 and 5 of the invention demonstrate that both additive components (B) and (C) are also required to pass the VCBT test when the lubricant includes a salicylate detergent system.

TABLE 1

| | Ref 1A | Ref 1B | Lube 1 | Ref 2 | Lube 2 | Ref 3 | Lube 3 | Ref 4 | Lube 4 | Lube 5 |
|---|---|---|---|---|---|---|---|---|---|---|
| Additive Component B | — | 0.10 | 0.10 | 0.10 | 0.10 | — | 0.42 | — | 0.30 | 0.30 |
| Additive Component C | — | — | 0.10 | — | 0.20 | 0.50 | 0.50 | — | 0.50 | 0.50 |
| Non-borated dispersants | 6.50 | 6.50 | 6.50 | 6.50 | 6.50 | 5.20 | 5.20 | 6.50 | 5.55 | 6.50 |
| Overborated dispersant | 0.50 | 0.50 | 0.50 | 0.50 | 0.50 | — | — | 0.50 | 0.55 | 0.50 |
| Calcium sulphonate TBN 295 | 1.80 | 1.80 | 1.80 | 1.80 | 1.80 | 2.51 | 2.51 | — | — | — |
| Calcium phenate TBN 135 | 0.70 | 0.70 | 0.70 | 0.70 | 0.70 | 0.20 | 0.20 | — | — | — |
| Magnesium sulphonate TBN 395 | 0.60 | 0.60 | 0.60 | 0.60 | 0.60 | — | — | — | — | — |
| Magnesium salicylate TBN 345 | — | — | — | | | — | — | — | — | 1.00 |
| Calcium salicylate TBN 217 | — | — | — | | | — | — | — | — | 2.50 |
| Calcium salicylate TBN 64 | — | — | — | | | — | — | — | — | 0.80 |
| Calcium salicylate TBN 350 | — | — | — | | | — | — | 2.75 | 2.75 | — |
| Molybdenum friction modifier | 0.09 | 0.09 | 0.09 | 0.90 | 0.90 | — | — | — | — | — |
| ZDDP | 2.20 | 2.20 | 2.20 | 2.20 | 2.20 | 1.15 | 1.15 | 1.20 | 1.20 | 1.20 |
| Antioxidant | 0.60 | 0.60 | 0.60 | 0.60 | 0.60 | 0.50 | 0.50 | 0.50 | 0.50 | 0.50 |
| Anti-foam/LOFI/Tackifier | 1.40 | 1.40 | 1.40 | 1.40 | 1.40 | 0.30 | 0.30 | 0.30 | 0.30 | 0.30 |
| Viscosity modifier | 8.30 | 8.30 | 8.30 | 8.30 | 8.30 | 8.50 | 8.50 | 8.00 | 8.00 | 8.00 |
| Basestock | balance | balance | balance | balance | balance | balance | balance | balance | balance | balance |
| VW CBT Merits | 3 | 2 | 1 | 2 | 1 | 2 | 1 | 3 | 1 | 1 |
| Pass/Fail | Fail | Fail | Pass | Fail | Pass | Fail | Pass | Fail | Pass | Pass |

The invention claimed is:

1. A lubricating oil composition comprising:

(A) an oil of lubricating viscosity in a major amount;

(B) an oil-soluble or oil-dispersible additive component in a minor amount, obtained by reacting:

(b1) an aliphatic polyamine having at least two carbon atoms and at least two nitrogen atoms with at least one of the nitrogen atoms present in the form of a primary amine group and at least one of the remaining nitrogen atoms present in the form of a primary or secondary amine group, and (b2) an aliphatic hydrocarbyl mono acid or derivative thereof of formula I (I)

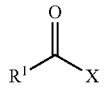

wherein $R^1$ represents a $C_9$ to $C_{29}$ aliphatic hydrocarbyl group and X represents —OH or a suitable leaving group in a compound of formula I, said reaction being conducted in a manner and under conditions sufficient to react at least one amine group of the aliphatic polyamine (b1) with the aliphatic hydrocarbyl mono acid or derivative thereof (b2) of formula I to form at least one amide and/or imidazoline group; and, (C) an oil-soluble or oil dispersible additive component in a minor amount comprising a primary amide of formula $R^6C(O)NH_2$ wherein $R^6$ represents a $C_9$ to $C_{29}$ aliphatic hydrocarbyl group;

wherein the lubricating oil composition is contaminated with at least 0.3 mass %, based on the total mass of the lubricating oil composition, of a biofuel or a decomposition product thereof and mixtures thereof.

2. The lubricating oil composition as claimed in claim 1, wherein the biofuel is an alcohol based fuel.

3. The lubricating oil composition as claimed in claim 2, wherein the alcohol based fuel is an ethanol based fuel.

4. The lubricating oil composition as claimed claim 1, wherein additive component (B) includes at least one primary or secondary amine group.

5. The lubricating oil composition as claimed in claim 1, wherein the aliphatic polyamine (b1) is an aliphatic $C_2$ to $C_{20}$ hydrocarbyl polyamine wherein at least two of the nitrogen atoms are present in the form of a primary amine group.

6. The lubricating oil composition as claimed in claim 1, wherein the aliphatic polyamine (b1) is a polyalkylene polyamine having at least 3 nitrogen atoms and 4 to 20 carbon atoms, wherein at least two of the nitrogen atoms are present in the form of a primary amine group and at least one of the remaining nitrogen atoms is present in the form of a secondary amine group.

7. The lubricating oil composition as claimed in claim 6, wherein the polyalkylene polyamine which (b1) represents is a polyethylene polyamine.

8. The lubricating oil composition as claimed in claim 7, wherein the polyethylene polyamine comprises tetraethylene pentamine.

9. The lubricating oil composition as claimed in claim 1, wherein the aliphatic polyamine (b1) comprises a compound of formula II:

(II)

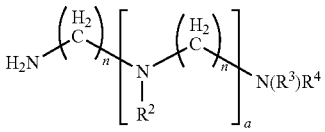

wherein: each $R^2$ independently represents at each occurrence hydrogen, $C_1$ to $C_{12}$ alkyl, $C_2$ to $C_6$ alkenyl or $C_1$ to $C_{12}$ alkyl amine; $R^3$ and $R^4$ each independently represent hydrogen, $C_1$ to $C_{12}$ alkyl, $C_2$ to $C_6$ alkenyl or $C_1$ to $C_{12}$ alkyl amine; a is an integer from 0 to 10; each n independently represents at each occurrence an integer from 2 to 6; with the proviso that when a is 0 then at least one of $R^3$ and $R^4$ represents hydrogen.

10. The lubricating oil composition as claimed in claim 1, wherein R' in the aliphatic hydrocarbyl mono acid or derivative thereof (b2) of formula I represents an acyclic $C_9$ to $C_{29}$ alkyl group.

11. The lubricating oil composition as claimed in claim 10, wherein the acyclic $C_9$ to $C_{29}$ alkyl group which R' represents in a compound of formula I is a branched chain acyclic $C_9$ to $C_{29}$ alkyl group.

12. The lubricating oil composition as claimed in claim 1, wherein the aliphatic hydrocarbyl mono acid or derivative thereof (b2) of formula I comprises isostearic acid or a derivative thereof, stearic acid or a derivative thereof.

13. The lubricating oil composition as claimed in claim 1, wherein $R^6$ in a compound of formula $R^6C(O)NH_2$ which additive component (C) represents is an acyclic $C_9$ to $C_{29}$ alkenyl group having a single double bond.

14. The lubricating oil composition as claimed in claim 1, wherein additive component (C) is oleamide.

15. A method of lubricating a spark-ignited or compression-ignited internal combustion engine which is fuelled with a biofuel, comprising operating the engine with a lubricating oil composition, comprising: (A) an oil of lubricating viscosity in a major amount; a minor amount of an oil-soluble or oil-dispersible additive component (B); and, a minor amount of an oil-soluble or oil-dispersible additive component (C), wherein said oil-soluble or oil-dispersible additive component (B) and said an oil-soluble or oil-dispersible additive component (C) are each as defined in accordance with claim 1.

* * * * *